US006311604B1

(12) United States Patent
Foris et al.

(10) Patent No.: US 6,311,604 B1
(45) Date of Patent: Nov. 6, 2001

(54) PROTECTIVE MISSILE LAUNCH TUBE ENCLOSURE

(75) Inventors: Victor G. Foris, Marina Del Rey; Takeshi Tokiyama, Los Angeles, both of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 07/516,405

(22) Filed: Apr. 30, 1990

(51) Int. Cl.[7] ..... F41F 3/04
(52) U.S. Cl. ..... 89/1.817
(58) Field of Search ..... 89/1.817, 1.816, 89/1.8

(56) References Cited

U.S. PATENT DOCUMENTS 3,362,291 * 1/1968 De Luca ..... 89/1.817
3,456,552 * 7/1969 Nash ..... 89/1.817
3,754,497 * 8/1973 Rusbach ..... 89/1.817
4,301,708 * 11/1981 Mussey ..... 89/1.817
4,455,917 * 6/1984 Shook ..... 89/1.817
4,498,368 * 2/1985 Doane ..... 89/1.817
4,649,795 * 3/1987 Olander ..... 89/1.817

FOREIGN PATENT DOCUMENTS

2424480 * 12/1974 (DE) ..... 89/1.817

* cited by examiner

*Primary Examiner*—Michael J. Carone
(74) *Attorney, Agent, or Firm*—Leonard A. Alkov; Glenn H. Lenzen, Jr.

(57) ABSTRACT

A missile launch system is described in which a missile launch tube has the launch end thereof protected by a hollow launch tube cover. The launch tube cover is divided into a plurality of segments which are frangible and are dispersed during launch of a missile 62. The surfaces of the individual segments are coated with water repellant material such as tetrafluoroethylene or silicone to prevent ice buildup. Moreover the outer surface of the head of the launch tube cover can be coated with a layer of metallic material to prevent electro magnetic interference or radio frequency interference. The launch tube cover is constructed of a light weight, water proof material such as an expanded closed cell foam including polyurethane foam.

15 Claims, 2 Drawing Sheets

PROTECTIVE MISSILE LAUNCH TUBE ENCLOSURE

BACKGROUND OF THE INVENTION

1. Field of the Invention

This invention relates to missile launchers and more particularly to protection for missile launch tubes.

2. Description of Related Art

Foreign matter can have a deleterious effect on a missile launch tube and the launching of missiles. Among the troublesome foreign matter are ice build up and debris which, if located within the missile launch tube, can result in damage to the tube, damage to the missile itself and undesirable launch characteristics for the missile.

Heretofore a number of techniques have been used to protect the missile launch tube and the missile. For example, the missile launch tube has been heated or pyrotechnic frangible covers have been provided. Moreover, plugs and retractable and unretractable caps have been utilized. In addition, diaphragms have been disposed across the face of the missile launch tube. All of these approaches have exhibited varying degrees of success.

Among the less than desirable characteristics exhibited by these types of devices were that they did not adequately prevent ice buildup, they tended to remain in the missile launch path too long and they created debris problems of their own which could impact on the missile, on adjacent missile launch tubes or on the launch vehicle itself. For example, a hollow foam plug was tried and it tended to ride on the nose of a launched missile. In addition, other plugs tended to ice up and freeze into a solid piece.

SUMMARY OF THE INVENTION

The present invention utilizes a missile launch tube cover comprising a hollow insert made of a light weight foam material which is divided into a plurality of "pie shaped" or radial segments. The cover is disposed in one end of an airborne or ground based missile launch tube such that when the missile is launched it tends to displace the cover and direct the segments in a radial direction because of positive air pressure imparted to the concave inside surfaces of the cover by the missile. A coating is formed on the outer surfaces of the cover to prevent icing and/or electromagnetic interference.

There are numerous advantages to this approach. For example, tile cover does not affect the missile exit. Moreover, it does not ride on the missile nose because its individual segments are each displaced in a radial direction away from the missile path. Thus, these segments do not then interfere with the missile's aerodynamics, control surfaces, or any guidance or control wire for wire guided missiles. Also, the individual segments are small and lightweight and do not create surface damage to the launch vehicle or damage to any adjacent launch tube covers. Additional advantages are that this missile cover is not withdrawn from the launch tube by negative air pressure created by launch of adjacent missiles and is not damaged or undesirably affected by the positive aerodynamic pressure or flash of adjacent launched missiles. Also the cover does not ice up and freeze into a unitary block.

DESCRIPTION OF THE PREFERRED EMBODIMENTS

Figure 1:
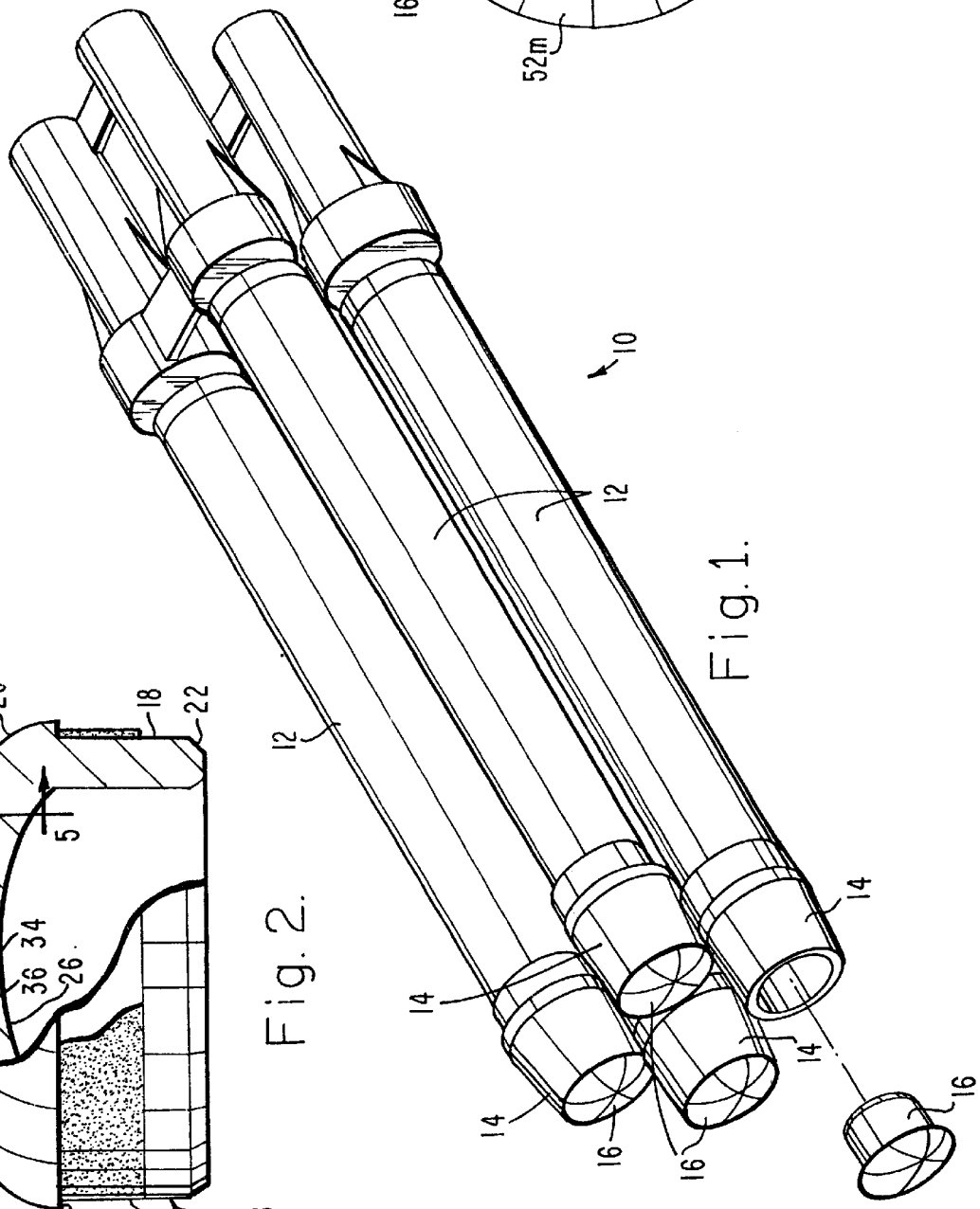
FIG. 1 is a perspective view of a four round modular launcher with launch tube covers.

Referring now to the drawings in more detail, FIG. 1 illustrates a four round missile launcher 10 showing four individual missile launch tubes 12 disposed in quadrilateral array relative to their launch axes. Of course, it should be understood that a single round missile launcher could be provided or that more than a four round missile launcher could be provided. Disposed at the end of each missile launch tube 12 is a front extension tube 14 into which is to be inserted a launch tube cover 16. Three of these launch tube covers are illustrated as being fully inserted into the extension tube 14 and one of these covers 16 is illustrated as being displaced from a launch tube along a launch axis prior to insertion into the extension tube 14.

Figure 2:
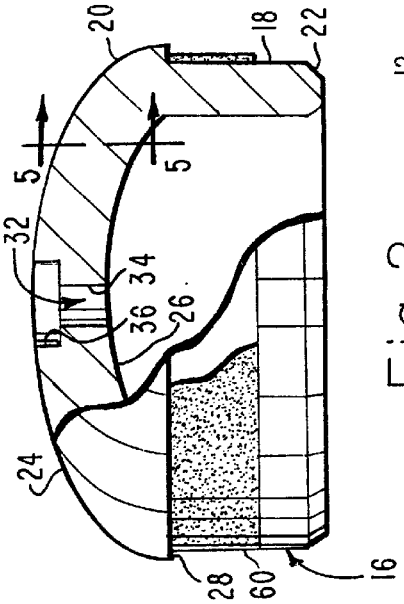
FIG. 2 is a side view of a launch tube cover partially in cross section.

As illustrated in more detail in FIG. 2, each of the launch tube covers 16 comprises a hollow cylindrical body portion 18 and a hollow head portion 20. The body portion 18 has an outside diameter dimensioned to frictionally fit within the extension tube 14. In addition the end of the body portion 18 is champhered at 22 to aid insertion into the extension tube 14.

The head portion 20 has a convex outer surface of an aerodynamic configuration and a concave inner surface conforming generally with the convex outer surface. The head portion 20 is dimensioned so that it has an outside diameter which is larger than the diameter of the body portion 18 thereby creating a flange 28 which will abut the outermost lip or end of the extension tube 14 when slidably inserted into the extension tube 14.

Figure 4:
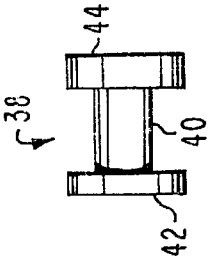
FIG. 4 is a side view of a pug that is fitted into the head of the launch tube cover.

An aperture 32 is formed through the head portion 20 at the axial center thereof. This aperture 32 comprises an inner bore 34 having a first diameter and an outer bore 36 having a larger diameter. This outer bore 34 forms a recess in the face of head 20. This aperture is thus configured to receive a plug 38 illustrated in FIG. 4 in an enlarged scale.

The plug 38 functions to hold individual segments of the launch tube cover 16 in place and blocks the passage of moisture through the center of the head 20 of the launch tube cover 16. More specifically the plug 38 includes a cylindrical body 40 and two circular end members 42 and 44 each having a greater diameter than the diameter of the cylindrical body 40. This plug 38 is dimensioned to fit closely within the aperture 32 so that moisture cannot enter and affords rigid structural support at the center of head 20.

Figure 3:
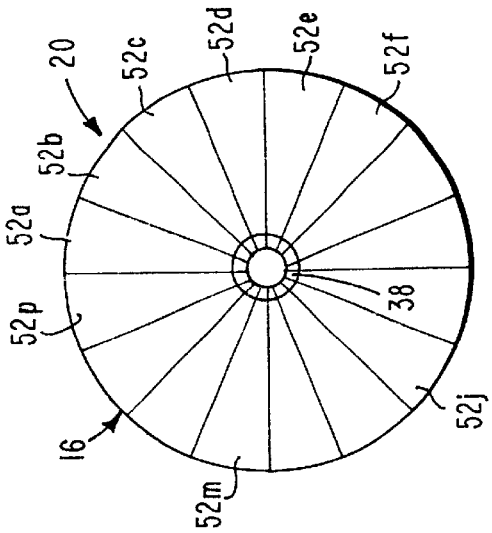
FIG. 3 is a front view of the launch tube cover illustrating the radial segmentation of the head thereof.

As illustrated most clearly in the front end view of FIG. 3 the launch tube cover 16 is divided into a number of segments 52(*a*), 52(*b*), 52(*c*) . . . 52(*p*). The dividing planes for each of these segments extend radially through the axis of the launch tube cover 16. While the sixteen segments 52(*a*) etc. have been illustrated and have proved successful, it should be understood that fewer or more segments may be used depending upon the structural strength of the material used and the mass of the individual segments.

The individual segments 52(*a*) etc. can be formed by cutting a molded unitary launch tube cover 16 along the radial planes or by molding them as individual segments 52(*a*) etc. The interfacing surfaces between each of the segments 52(*a*) etc. will be substantially identical and will closely fit together when assembled as the launch tube cover 16.

The launch tube cover 16 and plug 38 are made of a lightweight, water proof material such as an expanded foam. Materials that have proved to be desirable are of the closed cell foam type. An especially useful foam has been a polyurethane foam Type 1, Class 1 with a density of two pounds per cubic foot in accordance with the military specification MIL-D-26514B. It should of course be understood that other types of material could be used as long as they conform with the structural and operating constraints of the launch tube cover 16.

Figure 5:
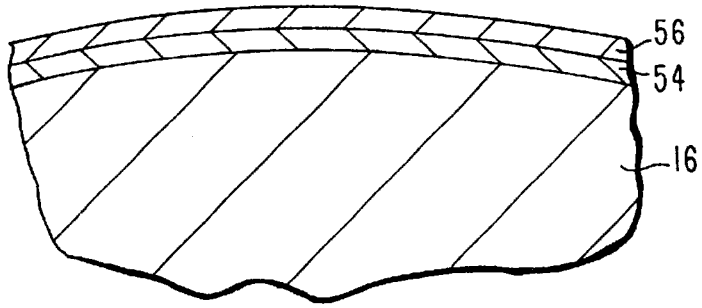
FIG. 5 is an enlarged broken away section illustrating coatings on the outer surface of the launch tube cover.

In order to prevent ice build up on the launch tube cover 16 and plug 38 during operation, the outer surface thereof is coated with a water repellant material such as tetrafluoroethylene or a silicone base coating as illustrated in the enlarged scale broken away section of FIG. 5. It is preferred that all surfaces of the individual segments 52(*a*) etc. be so coated. However it is important that at least the convex outer surface of the head 20 and the plug 38 be coated. By coating all surfaces ice buildup on the interface surfaces is prevented thereby insuring that the individual segments 52(*a*) etc. do not freeze into a unitary plug and are thus unable to separate into segments upon launch.

Moreover it aides in ejection of the cover 16 and separation of the individual segments 52(*a*) etc. from one another during launch.

Alternatively the convex surface of head 20 can be given an electro magnetic radiation coating for protection. This is accomplished with use of an electrically conductive coating 54 made up of a conventional metallic paste which is applied thereon. As a result, this coating 54 will protect the missile from electro magnetic interference. Thereafter, if desired, an outer most coating 56 of tetrafluoroethylene or silicone can be applied.

Figure 6:
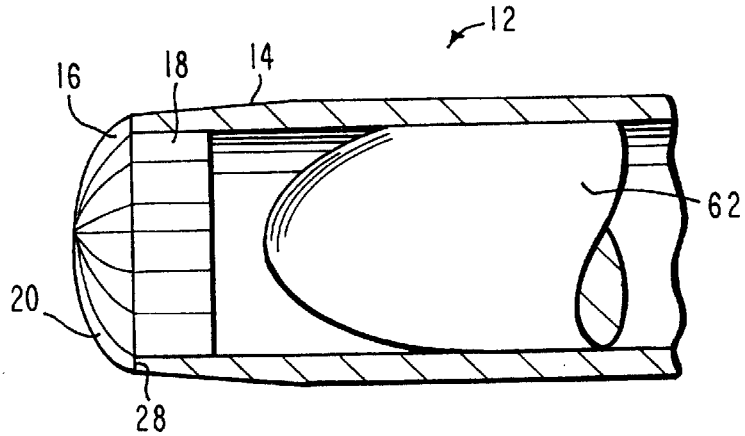
FIG. 6 is a side view partially in cross section of the launch tube cover disposed within a missile launch tube.

As illustrated in FIG. 2 the assembled launch tube cover 16 has the individual segments 52(*a*) etc. held in place by a tape 60 wrapped around the cylindrical body portion 18 thereof. During installation of the cover 16 into the extension tube 14, cylindrical body portion 18 is partially inserted up to about the edge of the tape 60. At this time the tape 60 is removed and the launch cover 16 is fully inserted into the extension tube 14 up to flange 28 where it is held in place by a friction fit as illustrated in FIG. 6. In addition the soft segments are squeezed together making a tighter seal.

Instead of using tape it should be possible to use other available techniques.

Figure 7:
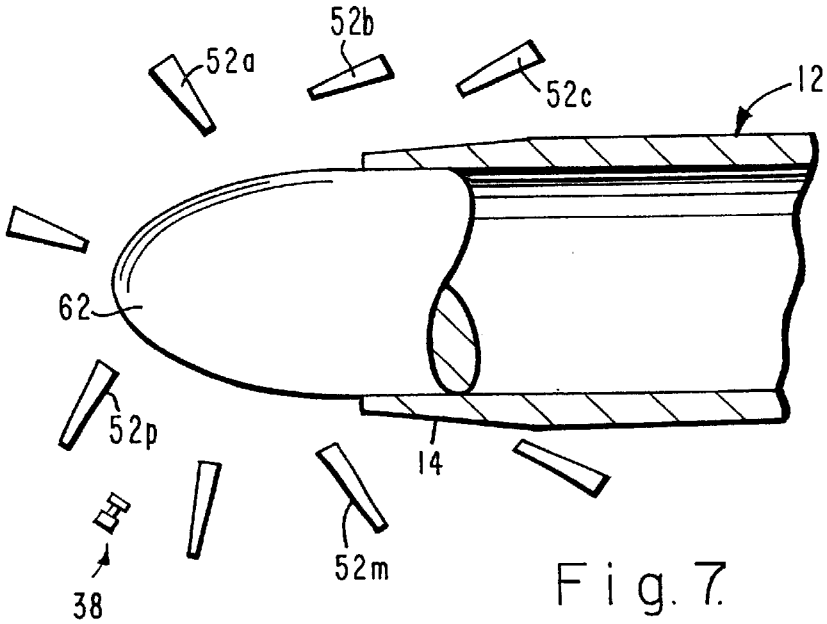
FIG. 7 is a side view of the missile launch tube illustrating the dispersal of the launch tube cover segments ejected during a missile launching.

During operation a missile 62 is launched within the missile launch tube 12 as illustrated in FIG. 7. The resulting air pressure built up between the nose of the missile 62 and the concave inner surfaces of the launch tube cover 16 pushes out the launch tube cover 16 so that the individual segments 52(*a*) etc. fragment and are dispersed in radial directions relative to the launch axis. This radial dispersal is typically more uniform in pattern than is illustrated. As a result of such radial dispersal, these segments 52(*a*) etc. do not interfere with the missile launch and are unable to ride on the missile nose or otherwise affect control members. Moreover the nose of the missile 62 never touches the launch tube cover 16 thereby making it useful for protecting a missile with sensitive optics or electronics in its nose.

Furthermore, because of the light weight, no unacceptable debris is created and when helicopters are used as the launch vehicle the prop down wash pushes the individual elements away from the launch vehicle and the launch path of the missile. On top of this, the individual segments 52(*a*) etc. are sufficiently light and soft so that there should be no surface damage to the launch vehicle or adjacent launch tube cover 16 if the segments should strike. Even if a segment were to strike the launch vehicle surface the segment would tend to disintegrate because of its structural composition.

Moreover because of their structure and configuration the launch tube covers 16 are not withdrawn from the extension tubes 14 as a result of negative aerodynamic pressure created by launch of adjacent missiles. In addition they can withstand positive aerodynamic pressures created by the burn of adjacent missiles and can withstand the debris created by such launches.

Furthermore in those instances when a wire guided missile is utilized the individual segments 52(*a*) etc. do not interfere with the thin guidance wire which trails out of the end of the missile.

During adverse operating conditions when icing can occur the coating 54 or 56 and the aerodynamic concave surface of the head portion 20 tend to shed any moisture such that there is substantially little or no ice buildup on the outer surface of the head 20 or between the segments 52(*a*) etc. of the launch tube cover 16. In addition, there can be no ice buildup within the end of the extension tube 14 of the missile launch tube 12.

While salient features have been described with respect to particular embodiments, many variations and modifications can be made without departing from the scope of the invention. Accordingly that scope is intended to be limited only by the scope of the appended claims.

What is claimed is:

1. A missile launch system comprising:

a launch tube operable to have a missile disposed therein;

a hollow launch tube cover having a body portion and a head portion with a convex surface the body portion being disposed to frictionally fit within one end of said launch tube and said head portion forming an outer surface and a flange which abuts the lip of said launch tube when said body portion is inserted therein, said launch tube cover being further divided into a plurality of segments along planes which extend generally through the axis of said launch tube cover, and said launch tube cover being comprised of an expanded foam material.

2. The missile launch system of claim 1 in which said individual segments are held together by a tape disposed around the body portion thereof.

3. The missile launch system of claim 1 in which said head portion surface is convex.

4. The missile system of claim 1 in which at least the convex surface of said head portion is a coating of water repellant material.

5. The missile launch system of claim 1 in which said convex surface of said head portion is a coating of electrically conductive material.

6. The missile launch system of claim 1 in which all surfaces of said segments are a coating of water repellant material.

7. The missile launch system of claim 6 in which said head portion outer surface is convex.

8. The missile launch system of claim 1 in which said head portion is concave whereby radial force relative to a launch axis is extended on said segments by positive air pressure within said launch tube to disperse said segments away from the launch axis during missile launch.

9. The missile system of claim 8 in which the outer surface of said launch tube covers is a coating of electrically conductive material and a coating of water repellant material.

10. The missile launch system of claim 9 in which the water repellant material consists of the class of tetrafluoroethylene and silicone.

11. The missile launch system of claim 1 in which said head portion has an aperture formed at the center thereof and extending therethrough and said head portion further comprises a plug member operable to closely fit within the aperture and being operable to structurally retain said segments.

12. The missile launch system of claim 11 in which said head portion is concave whereby radial force relative to a launch axis is exerted on said segments by positive air pressure within said launch tube to disperse said segments away from the launch axis during missile launch.

13. The missile launch system of claim 11 in which said individual segments are held together by a tape disposed around the body portion thereof.

14. The missile launch system of claim 13 in which all surfaces of said segments are a coating of water repellant material.

15. The missile launch system of claim 13 in which the expanded foam material is a water repellant material which consists of the class of tetrafluoroethylene and silicone.

* * * * *